US008107647B2

(12) United States Patent
Lenhardt

(10) Patent No.: US 8,107,647 B2
(45) Date of Patent: Jan. 31, 2012

(54) RING TRANSDUCERS FOR SONIC, ULTRASONIC HEARING

(75) Inventor: Martin L. Lenhardt, Hayes, VA (US)

(73) Assignee: Biosecurity Technologies, Inc., Richmond, VA (US)

( * ) Notice: Subject to any disclaimer, the term of this patent is extended or adjusted under 35 U.S.C. 154(b) by 1064 days.

(21) Appl. No.: 11/968,949

(22) Filed: Jan. 3, 2008

(65) Prior Publication Data

US 2008/0159574 A1 Jul. 3, 2008

Related U.S. Application Data

(60) Provisional application No. 60/878,113, filed on Jan. 3, 2007.

(51) Int. Cl.
*H04R 25/00* (2006.01)

(52) U.S. Cl. ..... 381/151; 381/326; 381/328; 381/380; 381/190; 607/56

(58) Field of Classification Search ..... 381/151, 381/328, 326, 380, 190; 379/430; 600/25; 607/56, 57
See application file for complete search history.

(56) References Cited

U.S. PATENT DOCUMENTS

| | | | | |
|---|---|---|---|---|
| 6,122,970 | A * | 9/2000 | Thurn | 73/662 |
| 2008/0019554 | A1 * | 1/2008 | Krywko | 381/380 |
| 2009/0134235 | A1 * | 5/2009 | Ivri | 239/4 |

* cited by examiner

*Primary Examiner* — Ngan Ngo
(74) *Attorney, Agent, or Firm* — Hershkovits & Associates LLC; Abraham Hershkovitz; Eugene C. Rzucidlo

(57) ABSTRACT

A ring transducer comprising an outer metal ring and an inner ceramic ring provides a device for the conduction of ultrasonic signals directly in the ear canal, thereby providing an efficient means for the conduction of such signals. In an alternate embodiment, stacks of piezoelectric film, optionally shaped into a ring, may be used for placement in the ear or outside the ear, such as on the ends of eyeglasses.

12 Claims, 3 Drawing Sheets

RING TRANSDUCERS FOR SONIC, ULTRASONIC HEARING

CROSS-REFERENCE TO RELATED APPLICATIONS

This application claims the benefit of provisional patent application No. 60/878,113 entitled "RING TRANSDUCER FOR ULTRASONIC HEARING" filed Jan. 3, 2007, the entirety of which is incorporated by reference.

FIELD OF INVENTION

This invention relates generally to a device for perception of and modulation of auditory signals into the ultrasonic frequency range.

BACKGROUND OF THE INVENTION

Ultrasonic hearing is a recognized auditory effect that allows humans to perceive sounds of a much higher frequency than would ordinarily be audible using the physical inner ear, usually by stimulation of the base of the cochlea through bone induction. Human hearing is recognized as having an upper bound around 17-20 kHz, depending on the person, but ultrasonic sinusoids as high as 120 kHz have been reported as successfully perceived.

Two competing theories are proposed to explain this effect. The first [1] asserts that ultrasonic sounds excite the inner hair cells of the cochlea basal turn, which are responsive to high frequency sounds. The second [2] proposed that ultrasonic signals resonate the brain and are modulated down to frequencies that the cochlea can then detect.

By modulating speech signals onto an ultrasonic carrier, intelligible speech has also been perceived with a high degree of clarity, especially in areas of high ambient noise. Deatherage [3] states that what humans experience as ultrasonic perception may have been a necessary precursor in the evolution of echolocation in marine mammals. During the last decade and a half, hearing aids based on that effect have been marketed. All to date use large and cumbersome external transducers awkwardly mounted on headbands. These aids also require substantial power, especially for those with severe hearing losses. As such, there is a present need for transducers which efficiently provide ultrasonic signals to the temporal bone.

REFERENCES

[1] Nishimura, T.; Nakagawa, S., Sakaguchi, T. (January 2003). "Ultrasonic masker clarifies ultrasonic perception in man". *Hearing Research* 175: 171-177.

[2] Lenhardt, M. (2003). "Ultrasonic hearing in humans: applications for tinnitus treatment". *Int. Tinnitus J.* 9 (2): 69-75.

[3] Deatherage, B.; Jeffress, L., Blodgett, H. (1954). "A Note on the Audibility of Intense Ultrasonic Sound". *J. Acoustic Soc. Am.* 26 (582). DOI:10.1121/1.1907379.

SUMMARY AND OBJECTS OF THE INVENTION

The present invention is a piezoceramic and/or piezoelectric film transducer fashioned in the shape of a ring having dimensions suitable for insertion into the ear canal. In an alternate embodiment, the transducer may comprise stacks of piezoelectric film shaped into a ring or a block such as for placement on or over the ends of eyeglass frames. The advantages of this invention comprise, in part, improved efficiency in power consumption, enhanced cosmetic appeal, and direct interfacing with the auditory functions of the ear.

By placing a transducer in the ear canal, the transducer is closer to the sensory organs and therefore stimulates the temporal bone more efficiently as well as being more cosmetically acceptable. The canal is also "open" thus not obstructing natural hearing. Such a device has numerous military, industrial and consumer application, particularly for use in communication systems. As such, the present invention comprises a ring transducer for ultrasonic hearing, comprising a metal ring having an inner surface and an outer surface and a ceramic ring having an inner surface and an outer surface, wherein the outer surface of the ceramic ring is disposed onto or affixed onto the inner surface of said metal ring; and wherein the ceramic ring and metal ring are adapted to resonate at a frequency in the ultrasonic frequency range. Additionally, the device will deliver sonic frequencies (~<2 kHz) to the bony canal.

BRIEF DESCRIPTION OF THE DRAWINGS

The present invention can best be understood in connection with the accompanying drawings. It is noted that the invention is not limited to the precise embodiments shown in drawings, in which.

BRIEF DESCRIPTION OF REFERENCE NUMERALS

100 Ring Transducer; 102 Outer Metal Ring; 104 Inner Ceramic Ring; 200 Ear Plug; 202 Flexible Bladder; 204 One-Way Valve Flaps; 206 Flexible Flanges; 402 Aluminum Cap; 404 Piezoelectric Disc; 406 Ring; 408 Terminal; 410 Plug; 412 Piezoelectric Film; 414 Piezoelectric Material; and 420 Piezoelectric Stacked Film Ring.

DETAILED DESCRIPTION OF THE INVENTION

RING TRANSDUCER FOR EAR PLUG/BUD: In the following description, an ear plug is demonstrated for use in conjunction with an embodiment of the ring transducer. Any ear plug of appropriate dimensions to hold the ring may be used. Additionally, the ring may be fashioned for direct insertion into the ear canal as a stand-alone unit.

Figure 1:
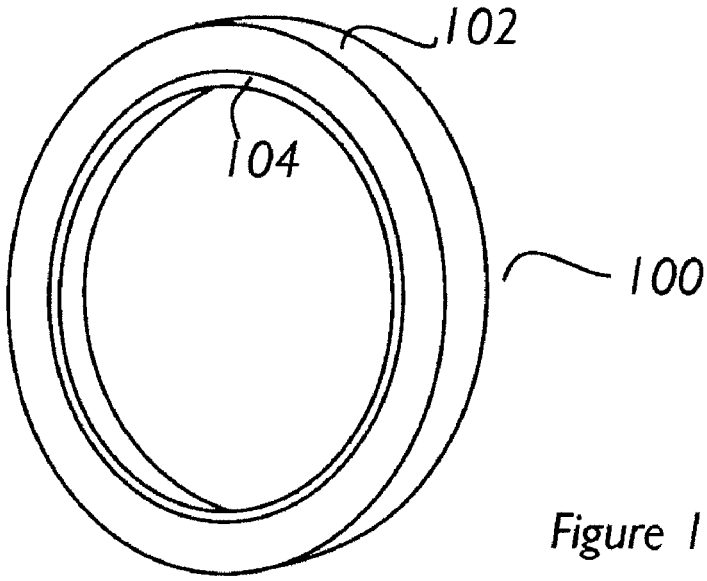
FIG. 1 is an isometric view of the ring transducer.
Figure 2:
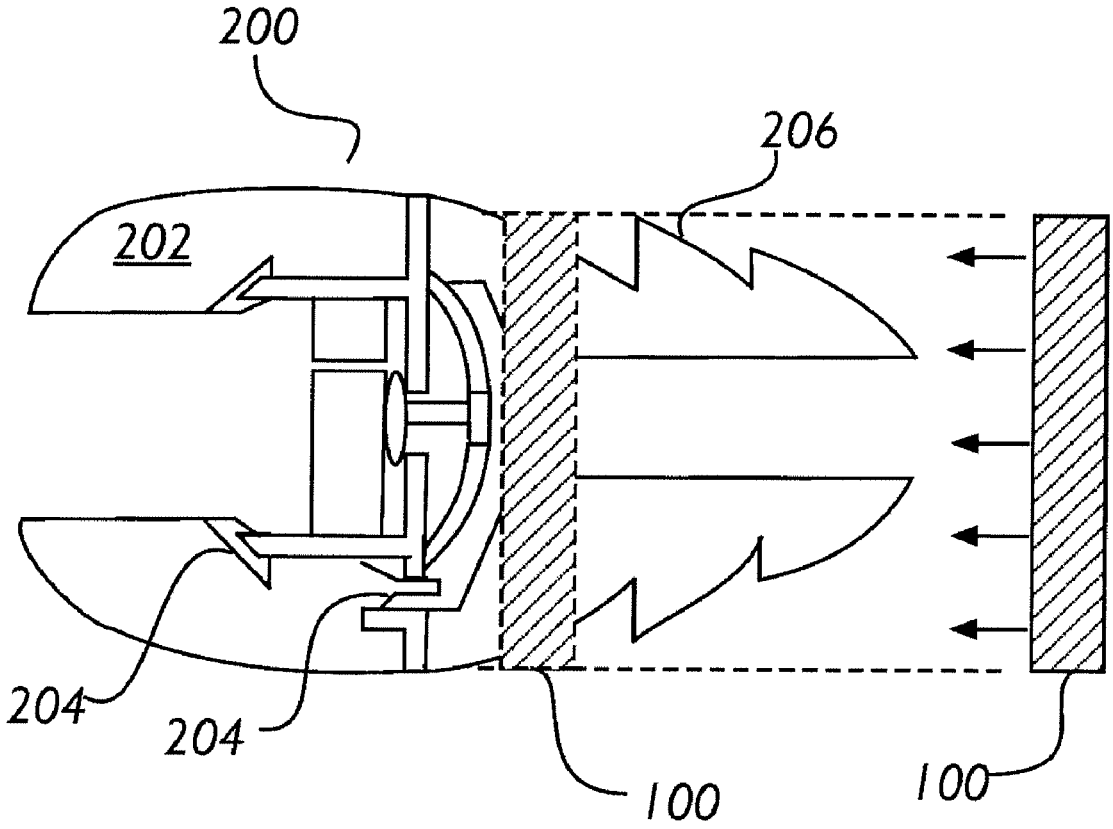
FIG. 2 is a side view of the ring transducer being inserted onto an earplug.

As can be seen in the drawings (FIGS. 1-2), The ring transducer 100 comprises an outer metal ring 102 and inner ceramic ring 104. The metal ring of the ring transducer maybe any type of metal adaptable for piezoelectric response but in a preferred embodiment comprises aluminum. The ceramic interior ring may be heat bonded, glued, or otherwise affixed to the interior of the metal ring. In one preferred embodiment the thickness of the rings when combined is about 0.5 mm and the outer ring has an outer diameter of about 7 to 9 mm. Since the ring transducer should be as close as possible to the auditory organs of the ear, the ring transducer may be adapted in dimension to fit the human ear canal. A number of sizes are contemplated since the human ear canal does not have a fixed dimension. Placement of the ring may be on any structure suitable for insertion into the human ear but in a preferred embodiment comprises the combination of a vacuum earplug and the ring, in which the ring is placed onto a flexible bladder portion of the earplug. The active range of the transducer may be adapted to any range above the normal auditory function of the human ear but is preferably between 25 and 30 kilohertz (kHz).

The ring transducer may be activated electrically to produce a piezoelectric response at high and/or ultrasonic frequencies, e.g., 2-100 kHz. The transducer provides a signal via the outward displacement of the transducer during vibration of the transducer upon activation by electrical energy. The combination of a ceramic and metal ring produces a bimorph. A bimorph is a cantilever that consists of two active layers. These layers produce a displacement via either thermal activation (a temperature change causes one layer to expand more than the other); and/or electrical activation, as in the piezoelectric bimorph of the present invention (electric field(s) cause one layer to extend and the other layer to contract). Such a displacement, in one embodiment, is outward (outward being the direction from the point comprising the center of the ring, i.e. the point at which the circumference of the ring is equidistant at all angles from the point, moving towards the circumference of the ring). Additionally, the outward displacement may be inward. Such a displacement may be a contraction of the ring inward followed by an outward expansion or an outward expansion followed by an inward expansion of the ring.

Audio frequencies can be used to enhance bone conducted hearing of speech by patients with presbycusis. The "natural" sound of the voice (<200 Hz) is preserved by the open bone conductor ring.

Figure 3:
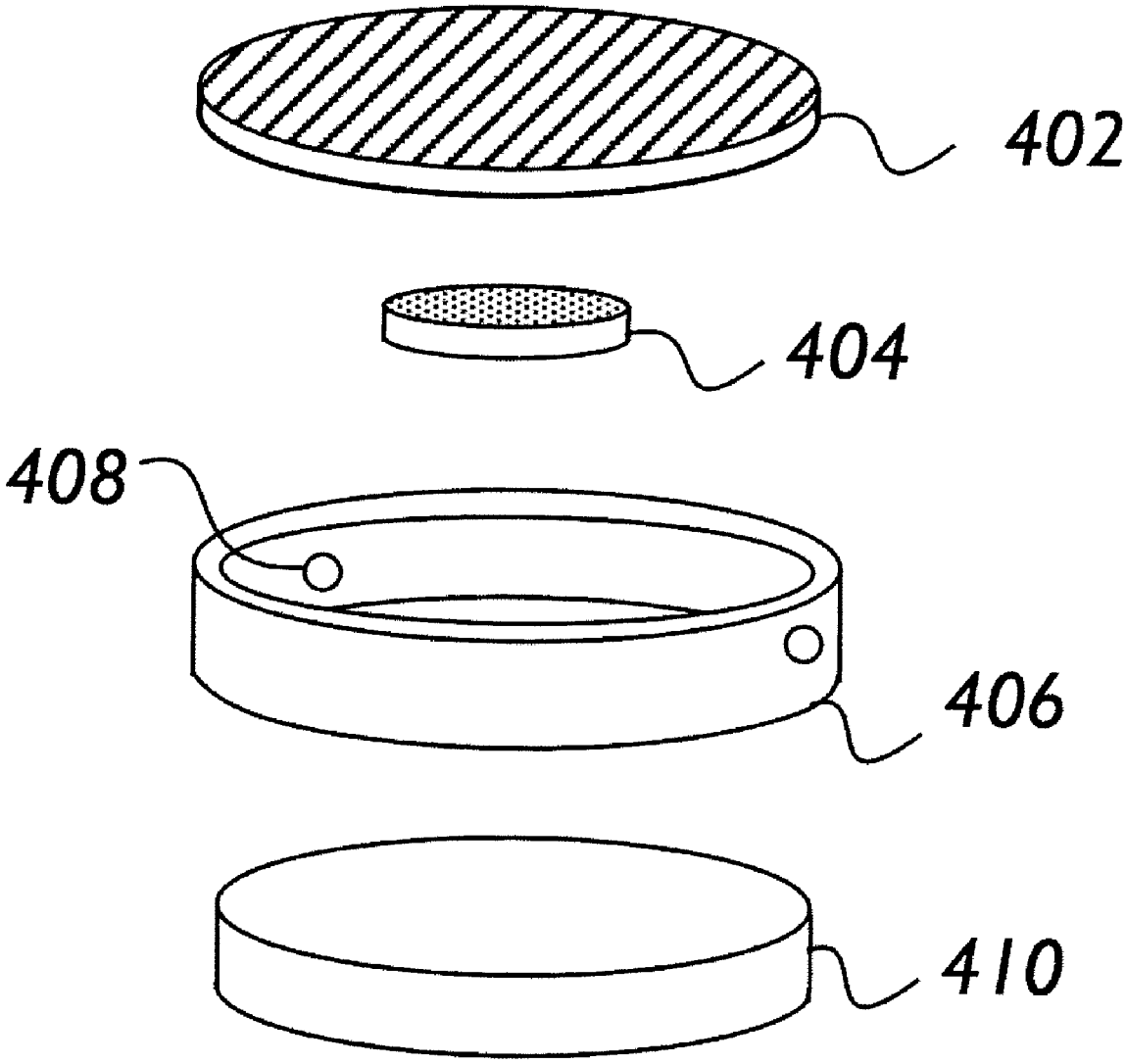
FIG. 3 is an exploded view of a ring transducer for conduction outside the ear canal.

RING TRANSDUCER FOR BONE: In an alternate embodiment, the piezoelectric device may once again be fashioned as a ring as seen in FIG. 3. In this version, the aluminum (or other material) ring does not comprise an inner ceramic or other piezoelectric material. Rather, an additional aluminum base comprising a piezoelectric disk, such as a ceramic disk, is provided. A plug may be used to provide a top enclosure. When the aluminum base is affixed onto a person, preferably in the head or neck region, the device functions to create a resonance with the head, thereby providing a means for transduction of a signal. More particularly, FIG. 3 shows the cap 402, also known as the base, which may be comprised of aluminum. On the base is a piezoelectric disk 404. Surrounding the base is a ring 406, which may also be comprised of aluminum. Terminals 408 are disposed in the ring 406. Finally a plug 410 may be placed into the remaining cavity to form the device into the shape of a solid cylinder. The plug may comprise a number of materials such as foam, metal, or other materials. Preferably, the materials are adapted to minimize disturbance to the sound generating properties of the device. Such materials are commonly known in the art.

Figure 4A:
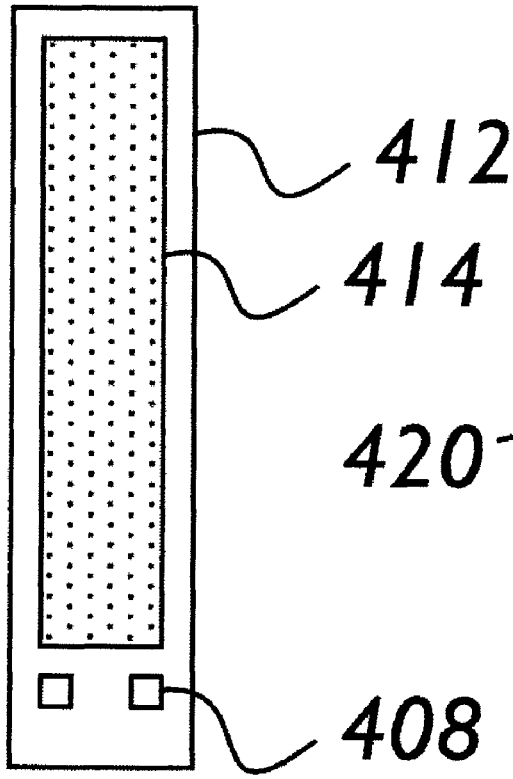
FIG. 4A is a plan view of a piezoelectric film.
Figure 4B:
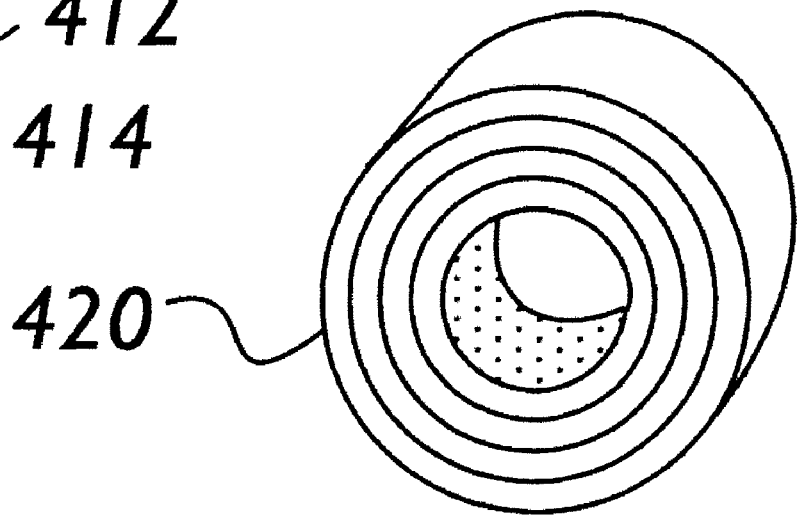
FIG. 4B is an isometric view of a stack of piezoelectric films formed into a ring.

PIEZOELECTRIC FILM STACKS: Peizo-electric films may also be used to form a ring transducer. In an exemplary embodiment, a piezoelectric film comprising a thin ring of polyvinylidine fluoride (PVDF) with electrically conductive nickel-copper alloy deposited on either side acts as the transducer upon electrical excitation. The film may be layered with a mylar or other biological inert substance to allow the film to be placed into contact with human anatomy. The layered, i.e. sheathed, film is flexible and may be rolled into a ring shape. Layering of sheathed films onto one another and rolling into rings provides a structure such as that found in FIG. 4B. As the number of films increases, the overall voltage driving the films may be increased, thereby also increasing the potential sound output. The only requirement is that an aperture remain for air conduction of sound. In this way, both transducer and ambient signals reach the inner ear and combine to produce enhanced hearing ability. The film may function, in one embodiment, to transmit ultrasonic signals, such as signals modulated onto an ultrasonic carrier wave, which are subsequently demodulated by the natural resonance of the brain and head structures. In a preferred embodiment, the piezoelectric film transducer may be placed onto the ear plug/bud described above to provide a secure means for insertion into the ear canal. In an alternate embodiment, the stacks may be fitted into the ends of eyeglasses in a manner such that the transducers may make direct contact with the head. This would provide a means for bone-conduction hearing and would also "hide" the hearing-aid in plain-view.

Finally, in operation, the ring transducer, in the piezoelectric film and metal/ceramic bimorph embodiments, is inserted into the ear canal, preferable coupled to an earplug or ear mold. The metal surface or film will then make contact with the bony portion of the ear canal. Voltage is applied to the metal/ceramic bimorph at high and/or ultrasonic frequencies. A user will then detect sound. Unlike previous transducers, the device is inserted directly into the ear and is not placed on the head or neck.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention. It is further known that other modifications may be made to the present invention, without departing the scope of the invention, as noted in the appended claims.

I claim:

1. A ring transducer for sonic and ultrasonic hearing and for insertion into a human ear, comprising:

a. a metal ring having an inner surface and an outer surface; and b. a ceramic ring having an inner surface and an outer surface, wherein the outer surface of the ceramic ring is disposed onto or affixed onto the inner surface of said metal ring;

wherein the ceramic ring and metal ring resonate at a frequency or frequencies in the sonic and/or ultrasonic frequency range.

2. The ring transducer of claim 1 in which said metal ring is made of aluminum.

3. The ring transducer of claim 1 in which said ceramic ring and said metal ring are adapted to match the dimensions of a human ear canal.

4. The ring transducer of claim 1 further comprising a piezoelectric film.

5. The ring transducer of claim 1 in which said transducer is adapted to be placed onto the body of a vacuum earplug.

6. The ring transducer of claim 1 in which the ultrasonic frequency range is between 25 and 30 kilohertz (kHz).

7. The ring transducer of claim 1 in which the ceramic ring is heat bonded or glued to the interior of the metal ring.

8. The ring transducer of claim 1 in which the transducer has a ring diameter of about 0.5 millimeters (mm) and the metal ring has an outside diameter of between 7 and 9 millimeters (mm).

9. The ring transducer of claim 1 in which the ring transducer is adapted to respond to an electrical voltage to produce a piezoelectric response.

10. The ring transducer of claim 9 in which said piezoelectric response occurs by the action of the bimorph formed between the ceramic and the metal ring.

11. The ring transducer of claim 9 in which said ring transducer is adapted to amplify speech frequencies to the ear canal for bone conduction.

12. A method of treating hearing loss comprising using the ring transducer of claim 1 by placing said ring transducer in an ear of a patient with hearing loss.

* * * * *